US007913938B2

(12) United States Patent
Cooper

(10) Patent No.: US 7,913,938 B2
(45) Date of Patent: Mar. 29, 2011

(54) ELECTROSTATIC SPRAY NOZZLE WITH ADJUSTABLE FLUID TIP AND INTERCHANGEABLE COMPONENTS

(75) Inventor: Steven C. Cooper, Athens, GA (US)

(73) Assignee: Mystic Tan, Inc., Farmers Branch, TX (US)

( * ) Notice: Subject to any disclaimer, the term of this patent is extended or adjusted under 35 U.S.C. 154(b) by 0 days.

(21) Appl. No.: 11/272,274

(22) Filed: Nov. 10, 2005

(65) Prior Publication Data

US 2006/0124780 A1 Jun. 15, 2006

Related U.S. Application Data

(60) Provisional application No. 60/627,191, filed on Nov. 12, 2004, provisional application No. 60/627,480, filed on Nov. 12, 2004.

(51) Int. Cl.
*B05B 5/00* (2006.01)
*B05B 5/03* (2006.01)

(52) U.S. Cl. ..... 239/690; 239/705; 239/291; 239/456; 239/539

(58) Field of Classification Search ..... 239/451, 239/453, 454, 456, 460, 537–541, 690–708, 239/583, 584, 290–301
See application file for complete search history.

(56) References Cited

U.S. PATENT DOCUMENTS 1,982,509 A 11/1934 Frank
2,361,144 A * 10/1944 Loepsinger ..... 239/8
2,728,606 A 12/1955 Juvinall et al.
2,954,146 A 9/1960 Hullman
3,332,623 A * 7/1967 Gallant ..... 239/105
3,764,068 A 10/1973 Lacchia et al.
4,004,733 A 11/1977 Law
4,289,276 A 9/1981 Bollina et al.
4,324,361 A * 4/1982 Moos et al. ..... 239/3
4,343,433 A 8/1982 Sickles
(Continued)

FOREIGN PATENT DOCUMENTS

EP 0031649 A2 9/1984
(Continued)

OTHER PUBLICATIONS

Cooper, S. C. and Law, S. E., "Electrostatic Sprays for Sunless Tanning of the Human Body", Proceedings of the ESA-IEEE Joint Meeting on Electrostatics, Jun. 25, 2003, pp. 1-12, University of Arkansas, Little Rock, Arkansas.

(Continued)

*Primary Examiner* — Jason J Boeckmann
(74) *Attorney, Agent, or Firm* — Gardere Wynne Sewell LLP

(57) ABSTRACT

An electrostatic spray charging nozzle designed for optimum charge level over a wide range of liquid and air flow rates. The electrostatic spray charging nozzle includes a nozzle cap having an outlet, a nozzle body having a first bore, and a fluid tip assembly extending at least partially through the first bore. The fluid tip assembly further includes a liquid inlet adapted to be connected to a source of liquid, and a liquid outlet adapted to dispense the liquid through the outlet of the nozzle body. The electrostatic spray charging nozzle further includes an adjustment mechanism operable to move the fluid tip assembly within the first bore so as to adjust a longitudinal distance between the liquid outlet of the fluid tip assembly and the outlet of the nozzle cap.

22 Claims, 4 Drawing Sheets

U.S. PATENT DOCUMENTS

| | | | | | |
|---|---|---|---|---|---|
| 4,357,900 | A | | 11/1982 | Buschor | |
| 4,545,536 | A | * | 10/1985 | Avidon | 239/695 |
| 4,664,315 | A | | 5/1987 | Parmentar et al. | |
| 4,688,518 | A | | 8/1987 | Missier | |
| 4,731,058 | A | | 3/1988 | Doan | |
| 4,750,704 | A | * | 6/1988 | Brundage | 251/30.02 |
| 4,846,525 | A | | 7/1989 | Manning | |
| 4,934,602 | A | | 6/1990 | Mattson | |
| 4,941,808 | A | | 7/1990 | Qureshi et al. | |
| 5,076,500 | A | | 12/1991 | Daniels | |
| 5,085,373 | A | | 2/1992 | Behr et al. | |
| 5,101,679 | A | | 4/1992 | Smith et al. | |
| 5,163,010 | A | | 11/1992 | Klein et al. | |
| 5,188,290 | A | * | 2/1993 | Gebauer et al. | 239/3 |
| 5,268,166 | A | | 12/1993 | Barnett et al. | |
| 5,277,713 | A | | 1/1994 | Gelain et al. | |
| 5,314,123 | A | * | 5/1994 | Miller | 239/708 |
| 5,322,684 | A | | 6/1994 | Barnett et al. | |
| 5,387,200 | A | | 2/1995 | Kronstadt | |
| 5,460,192 | A | | 10/1995 | McClain | |
| 5,494,674 | A | | 2/1996 | Barnett et al. | |
| 5,527,564 | A | | 6/1996 | Napadow et al. | |
| 5,545,140 | A | | 8/1996 | Conero et al. | |
| 5,577,660 | A | | 11/1996 | Hansen | |
| 5,591,412 | A | | 1/1997 | Jones et al. | |
| 5,603,127 | A | | 2/1997 | Veal | |
| 5,664,593 | A | | 9/1997 | McClain | |
| 5,685,482 | A | | 11/1997 | Sickles | |
| 5,704,554 | A | * | 1/1998 | Cooper et al. | 239/690.1 |
| 5,738,727 | A | | 4/1998 | Cebola et al. | |
| 5,738,728 | A | | 4/1998 | Tisone | |
| 5,765,761 | A | | 6/1998 | Law et al. | |
| 5,765,762 | A | | 6/1998 | Lee et al. | |
| 5,833,751 | A | | 11/1998 | Tucker | |
| 5,863,497 | A | | 1/1999 | Dirksing | |
| 5,868,311 | A | | 2/1999 | Cretu-Petra | |
| 5,922,333 | A | | 7/1999 | Laughlin | |
| 5,984,985 | A | | 11/1999 | Malone | |
| 6,003,794 | A | | 12/1999 | Hartman et al. | |
| 6,067,673 | A | | 5/2000 | Paese et al. | |
| 6,138,922 | A | | 10/2000 | Hartman et al. | |
| 6,199,557 | B1 | | 3/2001 | Laughlin | |
| 6,206,340 | B1 | | 3/2001 | Paese et al. | |
| 6,227,466 | B1 | * | 5/2001 | Hartman et al. | 239/704 |
| 6,250,601 | B1 | | 6/2001 | Kolar et al. | |
| 6,302,122 | B1 | | 10/2001 | Parker et al. | |
| 6,302,662 | B1 | | 10/2001 | Bensley et al. | |
| 6,326,062 | B1 | | 12/2001 | Noakes et al. | |
| 6,387,081 | B1 | | 5/2002 | Cooper | |
| 6,388,609 | B2 | | 5/2002 | Paese et al. | |
| 6,390,329 | B1 | | 5/2002 | Maddox | |
| 6,443,164 | B1 | | 9/2002 | Parker et al. | |
| RE37,888 | E | | 10/2002 | Cretu-Petra | |
| 6,481,634 | B1 | | 11/2002 | Zosimadis | |
| 6,513,787 | B1 | | 2/2003 | Jeromson et al. | |
| 6,554,208 | B1 | | 4/2003 | Venuto, Sr. | |
| 6,568,655 | B2 | | 5/2003 | Paese et al. | |
| 6,596,983 | B2 | | 7/2003 | Brent | |
| 6,802,830 | B1 | | 10/2004 | Waters et al. | |
| 7,004,407 | B2 | | 2/2006 | Cooper | |
| 7,021,494 | B2 | | 4/2006 | Mazooji et al. | |
| 2003/0127542 | A1 | | 7/2003 | Cooper | |
| 2004/0073186 | A1 | | 4/2004 | Cameron | |
| 2005/0281957 | A1 | | 12/2005 | Cooper et al. | |

FOREIGN PATENT DOCUMENTS

| | | | | |
|---|---|---|---|---|
| EP | 0031649 | B1 | | 9/1984 |
| EP | 0224352 | B1 | | 8/1990 |
| EP | 456523 | A2 | * | 11/1991 |
| EP | 0468736 | A1 | | 3/1997 |
| EP | 0468736 | B1 | | 3/1997 |
| EP | 0441501 | A1 | | 8/1997 |
| EP | 0441501 | B1 | | 8/1997 |
| EP | 1129784 | A | | 9/2001 |
| WO | WO 00/54892 | | | 9/2000 |

OTHER PUBLICATIONS

International Search Report for PCT/US 05/40956 dated May 26, 2006, completed Apr. 12, 2006.

International Search Report for PCT/US 00/05854 dated Jun. 15, 2000, completed Jun. 6, 2000.

"What Growers Should Know About Air-Assisted Electrostatic Spraying", Electrostatic Spraying Systems, Inc., 1992, Watkinsville, GA.

"Electrostatic Sprayers for Field Applications", Electrostatic Spraying Systems, Inc., Watkinsville, GA (no date given).

"Electrostatic Spraying for Greenhouses", Electrostatic Spraying Systems, Inc., Watkinsville, GA (no date given).

International Preliminary Report on Patentability for PCT/US2005/040956 dated May 24, 2007.

European Search Report and Written Opinion, EP 05 82 3418, Jun. 26, 2008.

* cited by examiner

ELECTROSTATIC SPRAY NOZZLE WITH ADJUSTABLE FLUID TIP AND INTERCHANGEABLE COMPONENTS

CROSS-REFERENCE TO RELATED APPLICATIONS

This application claims priority from and incorporates by reference the entire disclosure of U.S. Provisional Application No. 60/627,191 filed Nov. 12, 2004 and U.S. Provisional No. 60/627,480 filed Nov. 12, 2004.

BACKGROUND OF THE INVENTION

Embodiments of the present invention relate to electrostatic spray charging of conductive liquids, in particular to air-atomizing spray charging nozzles for conductive liquids that use the principles of induction or contact charging.

Electrostatic charging nozzles are well known and in widespread use in a number of commercial applications. Nearly every vehicle manufactured worldwide is painted electrostatically. Most of these industrial electrostatic spray systems charge spray by ionization and dispense powder or non-conductive liquids. There is a need for electrostatic spray devices that can reliably charge electrically conductive formulations, such as those that are water based. Several types of induction charging nozzles have been developed to produce electrostatically charged water sprays. U.S. Pat. No. 4,004,733 to Law shows an induction charging nozzle having a conductive ring surrounding a liquid jet inside a channel where high velocity air impacts the liquid stream, thereby creating a fine spray. Commercial versions of the nozzle described in the Law patent have been manufactured with deviations that include a liquid tip made from an insulating material, upstream grounding of the liquid, and lengthening the electrode to near the full length of the atomization channel. These modifications have made the nozzle of U.S. Pat. No. 4,004,733 reliable for use with water-based materials in most environments where the nozzle surfaces do not become excessively coated with conductive spray residue during a spraying operation. The conductive coatings on the surfaces of the nozzle can cause current leakage which reduces power supply voltage, damages surfaces, and reduces the internal charging field by elevating the voltage of the liquid stream.

Further patents to Cooper and Law, U.S. Pat. Nos. 5,704,554 and 5,765,761, utilize a fluid tip that is integral to the nozzle body, and utilize unique outside nozzle surface shapes to attempt to address some of the problems of stray electrical currents due to internal and external nozzle surface contamination. The fixed tip requires that the entire nozzle body be replaced in the event of mis-manufacturing, damage or wear, thereby increasing the cost and the effort of nozzle maintenance. The electrode portion of these nozzles is permanently pressed into the retaining cover. This does not allow replacement of the electrode alone—the entire cover assembly must be replaced. U.S. Pat. No. 4,343,433A to Sickles describes an induction charging nozzle with a fixed tip which utilizes air jets positioned around the main spray jet to prevent nozzle surfaces from becoming coated by spray. This method requires a significant amount of additional air energy, and the fixed tip and fixed electrode do not allow for adjusting for wear, machining tolerance, or replacing individual parts.

A series of electrostatic nozzle patents, U.S. Pat. Nos. 6,003,794, 6,138,922 and 6,227,466, to Hartman use an induction charging principle and liquid tip and air channel geometry that are similar to the above mentioned patents by Law, Cooper and Sickles. U.S. Pat. No. 6,003,794 describes nozzles having many components with stacked tolerances. These nozzles have a replaceable electrode but do not allow for adjustment. The nozzles mentioned in the above-identified patents charge well when made to precise, but expensive, machining tolerances, use matched components and are operated within a narrow range of liquid viscosities and liquid and air flow rates for a given internal spacing of components.

Variations in geometry of components causes charging variations which are due to improper droplet size or contact of the spray liquid with the walls of the induction electrode channel. Very small deviations in the internal spacing and dimensions of the atomization channel and liquid tip length have been observed to greatly diminish charging unless the air and liquid flows are within a narrow tolerance. These deviations occur due to nozzle manufacturing, from damage to components, and normal wear of components during use. Nozzle manufacturing deviations require that nozzle components be matched for optimal initial performance. This presents a problem since individual nozzle components wear over use and the entire nozzle often needs to be replaced with matching components. Measurements of spray charging from commercial versions of some typical nozzles with cost effective machining tolerances, but without using matched components, show over 30% variation from the same manufacturing run.

All of the above mentioned nozzles use air-atomizing induction-charging principles. With these nozzles the spray is charged to the opposite polarity as the electrode. Neither the liquid emitted from the tip nor the atomized spray is meant to contact the electrode. The advantage of such a system is that it produces high spray charging with very low electrode voltage and power. The disadvantage is that spray is attracted back to the nozzle surfaces. The wetted surfaces become conductive and reach the same polarity of the electrode, further attracting liquid spray droplets. The moisture deposits on the nozzle surface form into peaked shapes in response to the spray cloud space charge. The sharp points formed on these water droplets emit air ions that discharge large portions of the spray charge in the cloud. This effect can be minimized by adjusting the spray jet to a narrow column, using the air energy to force the spray a distance away from the nozzle. Another solution when this becomes a problem is to utilize contact charging principles. With contact charging types of nozzles the liquid stream is raised to a high voltage. This renders nozzle surfaces the same polarity as the spray cloud space charge and droplets are electrically repelled from the nozzle. The disadvantage is that the liquid container holding the spray liquid is also raised to high voltage, and as a result small containers should be used or isolation systems must be employed.

Operation of electrostatic charging nozzles in situations where contact with the nozzle by humans is possible, such as in applications of spray booths used for sunless-tanning, presents additional safety considerations in their design. One consideration is in limiting the exposure by humans to the electrode itself during operation. Another consideration is the reduction of the amount of leakage current from any portion of the nozzle where human contact could be made. The previously mentioned nozzles by Law and Cooper use an electrode which is embedded between layers of plastic or ceramic. This is an effective method for reducing the chance of direct contact with the electrode. However, commercial versions of the nozzle of U.S. Pat. No. 5,704,554 use an electrical contactor that is exposed when the cover is removed. This pointed contactor can be touched with the fingers and a shock can be received. The current from this contactor is in the range of 1 mA, capable of producing a shock intense enough to make the person involuntarily draw back very quickly and risk injury. Nozzles such as those described by Cooper and Law, Sickles, Hartman, and U.S. Pat. No. 4,664,315 to Parmentar et al. are induction charging devices and have the unfortunate characteristic of attracting spray back to the nozzle itself. This causes wetting of the nozzle face. Wetting by conductive liquids, near the jet outlet, can cause a conductive bridge to form to the electrode and cause shock when these forward nozzle surfaces are touched, even though the nozzle parts are made from insulating materials. The nozzle of Hartman, which is mounted with the electrode through a hole in a PVC tube structure, is particularly susceptible to leakage currents forward from the electrode. After a period of use black electrical tracking lines are evident on the surface of the tube. In addition the thin electrode cover may be easily removed during use causing direct exposure to the electrode.

Accordingly, there is a need for an air-atomizing charging nozzle for conductive liquids that has adjustable components to allow tuning for optimized spray quality and charging levels for a wide range of liquid viscosities and flow rates. It is desirable that the nozzle be manufactured with cost effective machining tolerances and not require component matching. It is also desirable that these tuning adjustments can be made while the nozzle is operating. It is also desirable that these adjustments remain set in place during normal nozzle operation. In addition, it is desirable to be able to easily replace and interchange nozzle components without adversely affecting charging and spray quality. Furthermore it is desirable to have the option to use the same nozzle as a contact charging device when necessary. Safety design considerations dictate that the nozzle have reduced leakage currents on all nozzle surfaces, particularly those interior and exterior surfaces which are easily touched by untrained operators.

BRIEF SUMMARY OF THE INVENTION

In the air-atomizing induction-charging nozzles described above, the most important dimension that affects charging level and droplet size is the depth that the liquid tip penetrates into the atomization/electrode channel. Variations in this depth can be caused by dimensional variations in tip and air channel geometry. Manufacturing variations or normal wear of either of these parts can cause droplet size and charging variations, as well as cause the spray to be misdirected in the slipstream of the atomization channel. In contact charging systems using an air atomizer, the droplet size and charging level are also affected by these same geometries.

An electrostatic spray charging nozzle according to at least one embodiment of the present invention comprises a liquid tip that can be accurately axially moved and set during operation of the nozzle to optimize charging and spray quality in both induction charging and contact charging configurations, as well as to increase the useable range of liquid flow rates and to reduce the effects of normal manufacturing variations. In addition, the key components of the nozzle in accordance with embodiments of the present invention can be easily removed and interchanged with those of other nozzles without affecting charging or spray quality. In one embodiment, the nozzle can be operated as a contact charging device by applying a voltage directly to the liquid. In an alternate embodiment, the nozzle can be operated as an induction charging device where a voltage is applied to the air cap/electrode and the spray liquid is earthed (grounded) near the nozzle. In accordance with at least one embodiment the air cap/electrode is easily removed from the retaining cap for replacement or substitution for a cap of a different geometry.

An embodiment of the present invention is directed to an electrostatic spray charging nozzle having a nozzle cap having an outlet, a nozzle body having a first bore, and a fluid tip assembly extending at least partially through the first bore, the fluid tip assembly having a liquid inlet adapted to be connected to a source of liquid, and a liquid outlet adapted to dispense the liquid through the outlet of the nozzle body. The electrostatic spray charging nozzle further includes an adjustment mechanism operable to move the fluid tip assembly within the first bore so as to adjust a longitudinal distance between the liquid outlet of the fluid tip assembly and the outlet of the nozzle cap.

Another embodiment of the present invention is directed to an electrostatic spray charging nozzle including a nozzle body having an air-channel bore; a nozzle cap having an outlet aligned with the air-channel bore, the nozzle cap adapted for removable coupling to a first side of the nozzle body; and a liquid inlet connector having a first end adapted to be coupled to a second side of the nozzle body, and a second end adapted to be connected to a source of liquid. The electrostatic spray charging nozzle further includes a fluid tip extending through the air-channel bore and having a fluid tip base adapted to be coupled to the first end of the liquid inlet connector, and a fluid tip outlet adapted to dispense the liquid through the outlet of the nozzle cap; and a conductive air cap having a bore aligned with the air-channel bore to receive the fluid tip outlet, the conductive air cap adapted to induce a charge to the liquid. The electrostatic spray charging nozzle still further includes an adjustment mechanism operable to move the fluid tip assembly within the air-channel bore so as adjust a longitudinal distance between the fluid tip outlet of the fluid tip and the outlet of the nozzle cap.

Another embodiment of the present invention is directed to an electrostatic spray charging nozzle having a nozzle cap having an outlet, a nozzle body having a first bore, and a fluid tip assembly extending at least partially through the first bore, and having a liquid inlet adapted to be connected to a source of liquid, and a liquid outlet adapted to dispense the liquid through the outlet of the nozzle body. The electrostatic spray charging nozzle further includes an adjustment mechanism operable to move the fluid tip assembly within the first bore so as to adjust an axial distance between the liquid outlet of the fluid tip assembly and the outlet of the nozzle cap.

DETAILED DESCRIPTION OF THE INVENTION

Figure 1:
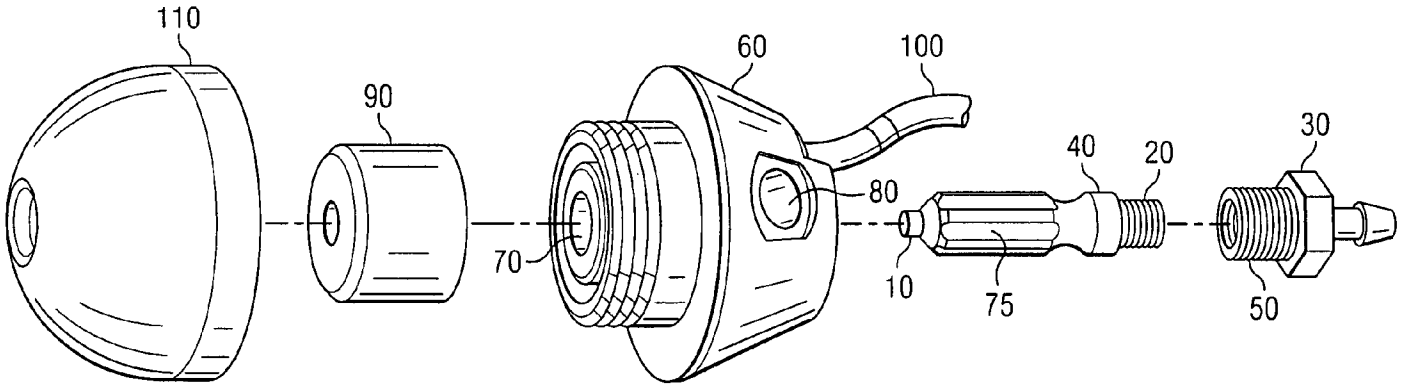
FIG. 1 is an exploded perspective view of one embodiment of the nozzle of the present invention shown disassembled to view the key components.

Referring now to FIG. 1, an embodiment of a nozzle of the present invention is illustrated in which a fluid tip 10 having a fluid tip base 20 with a threaded end is screwed into an inner threaded portion of a liquid inlet connector 30. In accordance with some embodiments of the present invention, the fluid tip can be comprised of a dielectric material. A sealing boss 40 on the fluid tip 10 provides for liquid sealing between the fluid tip 10 and the liquid inlet connector 30. The liquid inlet connector 30 is further provided with fluid tip length adjustment threads 50 along an outer circumference. The liquid inlet connector 30 is adapted to be connected to a source of spray liquid. The fluid tip length adjustment threads 50 are adapted to allow the liquid inlet connector 30 to be threaded into a back surface of a nozzle body 60. With the fluid tip 10 mounted to the liquid inlet connector 30, the selective threading of the liquid inlet connector 30 result in an adjustment in the axial/longitudinal positioning of the fluid tip 10 within a central air-channel bore 70 of the nozzle body 60.

In various embodiment of the present invention, the fluid tip 10 is a dual fluid tip that allows for the passage of air as well as a spray fluid. In an embodiment of the present invention, the fluid tip 10 is provided with air path cuts 75 in the sides which longitudinally extend to allow air to flow through the central air-channel bore 70 between the fluid tip 10 and the walls of the central air-channel bore 70. This allows for the passage of air while still allowing for concentric alignment of the fluid tip 10 with the central air channel. This design improves air flow uniformity in the atomization channel and helps prevent spray contact with the channel walls. The directed air within the nozzle further produces a narrow directed spray which provides concentrated air energy at the jet outlet of the nozzle and greatly reduces the return of charged spray to the nozzle and nozzle mounting components. The nozzle body 60 is further provided with an air inlet 80 for providing a flow of air or other gas from an external source through to the central air-channel bore 70. An air cap 90 (or electrode) having a bore or channel is further positioned at a front end of the nozzle body 60 to form an atomization/electrode channel. An electrode wire 100 is provided to apply a charge to the air cap 90 when the nozzle is to be used for induction charging, and the air cap 90 is made from conductive materials. For a contact charging configuration, the spray liquid itself is raised to a high voltage and the air cap 90 may be made from insulating materials. In this configuration, the electrode wire 100 may be omitted. A nozzle cap 110 (or retaining cap) is further provided to retain the air cap 90 in the nozzle assembly. In accordance with some embodiments of the present invention, the nozzle cap 110 may be comprised of a hemispherical nozzle cap. In accordance with still other embodiments of the present invention, the nozzle cap may have alternate shapes. The nozzle cap 110 can be further provided with an aperture or recess adapted to removably receive the air cap 90. In accordance with an embodiment of the present invention the air cap 90 is adapted to rotate freely about the fluid tip assembly, and is removable for repair and/or replacement if necessary.

Adjustment of the depth that the fluid tip 10 penetrates into the atomization channel is made by turning the liquid inlet connector 30 attached to the back of the nozzle body 60. The thread pitch of the liquid inlet connector 30 determines the amount of axial/longitudinal movement that is provided with respect to the placement and positioning of the fluid tip 60 in the atomization/electrode channel for each turn of the liquid inlet connector 30. The threads of the liquid inlet connector 30 act as an adjustment mechanism such that the longitudinal or axial distance between the liquid outlet of the fluid tip 10 and the outlet of the nozzle cap 10 can be adjusted within a predetermined range.

The nozzle of various embodiment of the present invention allows for components of the nozzle to be removed and interchanged easily, for example for cleaning or replacement. The removable and interchangeable components of the nozzle include the fluid tip 10, the nozzle cap 110, the air cap 90, and the nozzle body 60. For example, it may be desirable to replace the air cap 90 with one having a larger bore in order to permit more air flow. It also may be desirable to replace the fluid tip 10 with one of different outside and inside diameters to provide different spray characteristics such as droplet size, spray pattern and spray volume. Nozzle cap 110 can be replaced to change its outside surface size and/or shape.

Figure 2B:
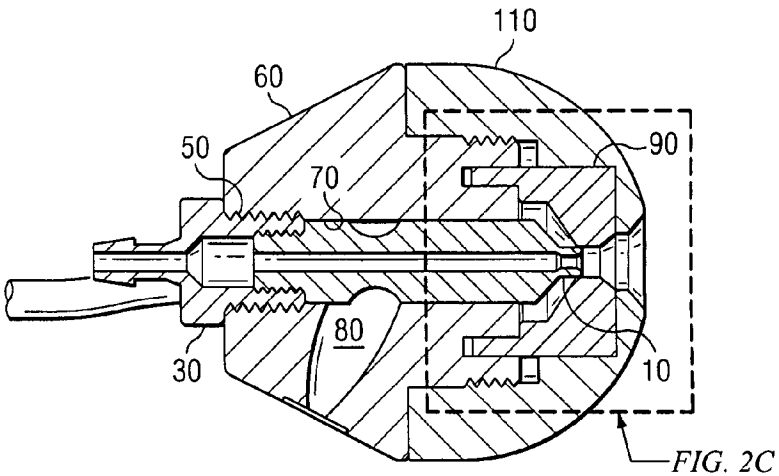
FIG. 2B is a section view of another embodiment of a nozzle of the present invention.
Figure 2A:
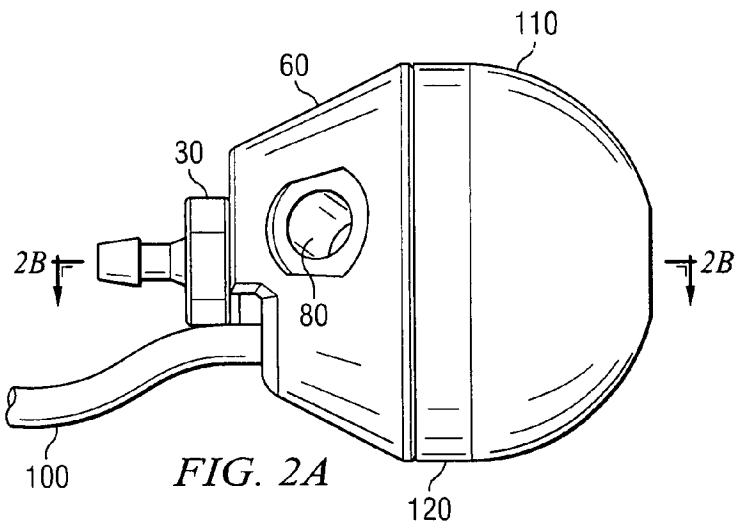
FIG. 2A is a side view of the one embodiment of the nozzle of the present invention shown assembled.

FIG. 2A illustrates a side view of one embodiment of a nozzle in accordance with the present invention shown in an assembled form. In the nozzle of FIG. 2A, the nozzle cap 110 is coupled to a front side of the nozzle body 60, and the liquid inlet connector 30 is coupled to a back side of the nozzle body 60. The nozzle of FIG. 2A may be further provided with a spacer ring 120 placed between the nozzle cap 110 and the nozzle body 60. In alternate embodiment of the nozzle of FIG. 2A, the spacer ring 120 may be removed for mounting of the nozzle to a panel.

FIG. 2B shows a section view of another embodiment of a nozzle in accordance with the present invention. In this mounting configuration, he panel occupies the space previously occupied by the spacer ring 120. Adjustment of the length of the fluid tip 10 is made by turning a fitting on the liquid inlet connector 30 connected to the back of the nozzle. The thread pitch of the fluid tip length adjustment threads 50 of the liquid inlet connector 30 controls the length of axial/longitudinal movement of the fluid tip 10 per turn. These fluid tip length adjustment threads 50 have been proven to seal the air very well even after many adjustment rotations have been made. The fluid tip 10 is shown inserted into the central air channel bore 70 of the nozzle body 60. The fluid tip 10 is held concentric in the air channel by ridges formed on the sides of the fluid tip 10.

Figure 2C:
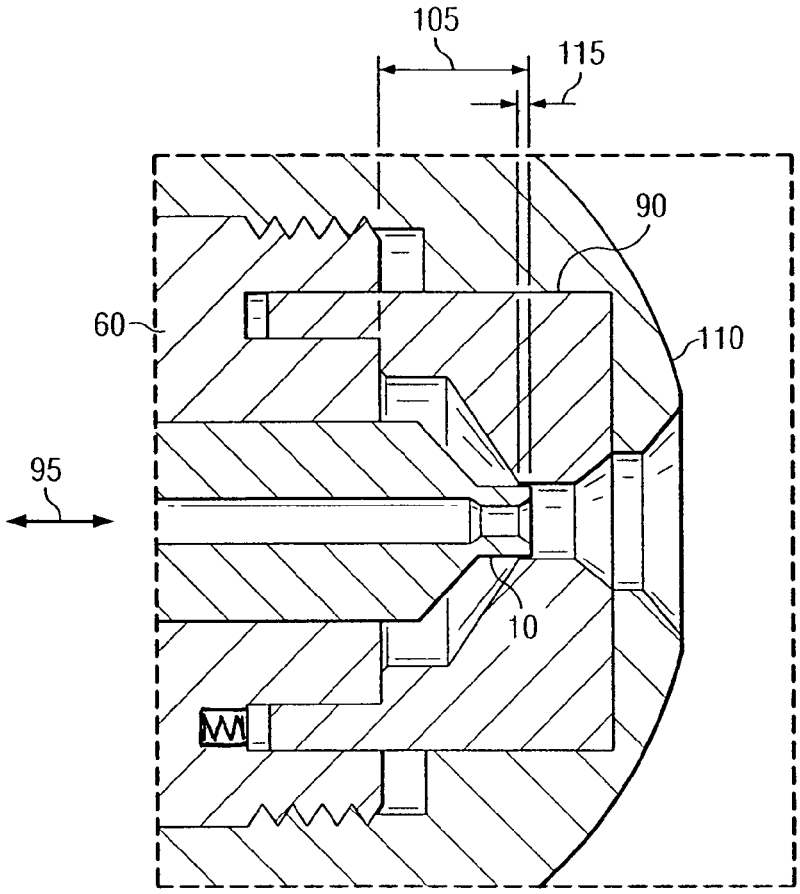
FIG. 2C shows a section view of the liquid tip area of the nozzle of FIG. 2B.

FIG. 2C shows a section view of the fluid tip 10 area of the nozzle of FIG. 2B. One aspect in accordance with embodiments of the present invention is that tightening the nozzle cap 110 pushes a ledge on the inside of the air cap 90 against a front face of the nozzle body 60 to cause a seal. This design reduces stacked tolerances seen in previous designs, since only the air cap 90 inside dimension need be made with tight tolerances and the nozzle cap 110 and nozzle body 60 can be made with loose, non-critical tolerances. Any variation due to manufacturing of the nozzle parts can be taken out by adjusting the fluid tip 10 by turning the fitting of the liquid inlet connector 30 on the rear of the nozzle. By rotation of the fitting of the liquid inlet connector 30, the fluid tip 10 is made to move in an axial direction 95, thereby changing a length 105 of the fluid tip 10 that is exposed from the nozzle body 60, as well as a depth 115 that the tip end penetrates into the channel of the air cap 90.

Figure 3:
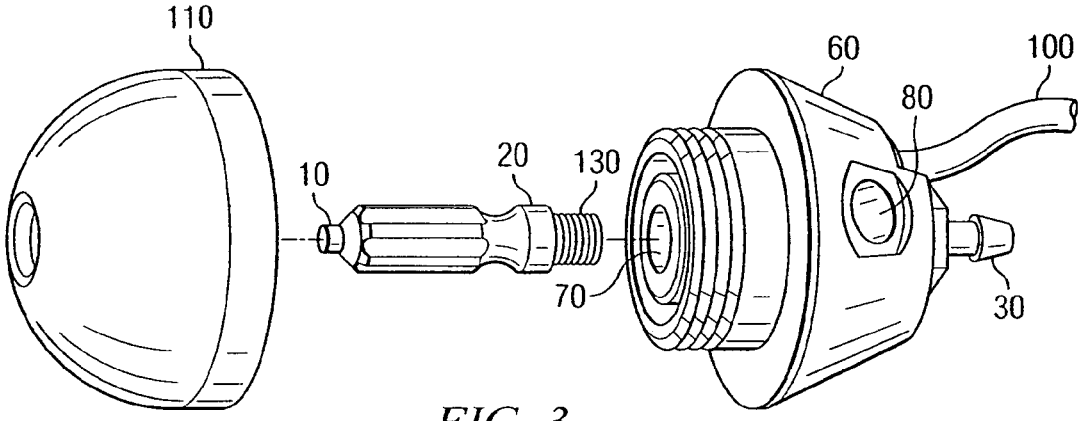
FIG. 3 shows one embodiment of the nozzle according to the present invention in which the fluid tip is removable from the front of the nozzle.

FIG. 3 shows one embodiment of the nozzle according to the present invention in which the fluid tip 10 is removable from the front of the nozzle assembly. This is accomplished by first removing nozzle cap 110, and then rotating fluid tip 10 to disengage the fluid tip 10 from the liquid inlet connector 30 while the liquid inlet connector 30 remains in place. Removal of the fluid tip 10 from the front is desirable in instances where the front of the nozzle is more accessible for maintenance. For instance, if the nozzle is panel mounted and closed in on the backside. The nozzle assembly of FIG. 3 further illustrates the fluid tip base 20 of the fluid tip 10 as having threads 130 to facilitate removable of the fluid tip 10 from the liquid inlet connector 30. The nozzle assembly of FIG. 3 is further provided with an electrode wire 100 to provide a high voltage to the spray liquid during a spraying operation.

Figure 4:
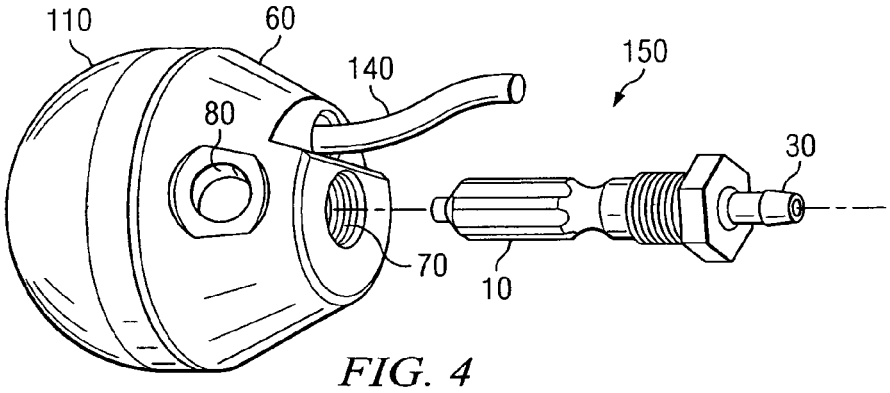
FIG. 4 shows one embodiment of the nozzle according to the present invention in which the fluid tip is removable from the rear of the nozzle.

FIG. 4 shows one embodiment of the nozzle according to the present invention in which a fluid tip assembly 150 comprised of a fluid tip 10 and liquid inlet connector 30 is removable from the rear of the nozzle body 60. This is accomplished by rotating the liquid inlet connector 30 to detach the liquid inlet connector 30 from nozzle body 60 while the fluid tip 10 remains attached to the liquid inlet connector 30. In accordance with some embodiments of the present invention, the fluid tip can be comprised of a dielectric material. Removal of the fluid tip 10 from the rear of the nozzle body 60 may be desirable is some situations. For instance, if the nozzle were operating alongside other nozzles and only one nozzle needed service, the fluid tip 60 could be removed from the rear of the nozzle body 60 without interfering in the spray of the adjacent nozzles.

Figure 5:
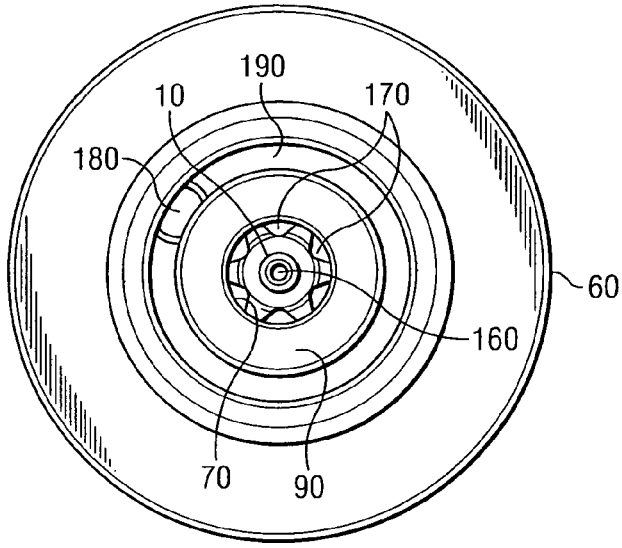
FIG. 5 shows a front view of the fluid tip of one embodiment of the present invention.

FIG. 5 shows a front view of a fluid tip 10 of one embodiment of a nozzle body of the present invention. The fluid tip 10 is removable and inserted into the central air channel bore 70. Cuts along the length of the side of the fluid tip 10 allow air to flow evenly around a liquid outlet 160 of the fluid tip 10 and mate the tip concentric with the inner wall of the central air channel bore 70. The ridges formed on the length of the fluid tip 10 hold the fluid tip 10 concentric with the central air channel bore 70 of the nozzle body 60 and provide for air channels 170 through which air or another gas can flow. This arrangement improves the concentricity of the removable liquid tip 10 with the nozzle body 60 and the air cap 90. An electrode contactor 180 is provided in the case of induction charging nozzles where a conductive air cap 90 is used in order to couple a high voltage from electrode wire 100 to the air cap 90. The electrode contactor 180 includes a contact pad adapted to contact a surface of the air cap 90. In one embodiment of the present invention, the contact pad may be comprised of a spring-loaded contact pad. The electrode contactor 180 is recessed in a ring cavity 190 or channel of the nozzle body 60 to prevent touching with fingers while operating. The ring cavity 190 allows for the seating of air cap 90 as can also be seen in FIGS. 2B and 2C. Although the embodiment of FIG. 5 is illustrated as having a ring cavity 190, it should be understood that in other embodiments a nozzle body can be used that does not have a ring cavity.

Figure 6:
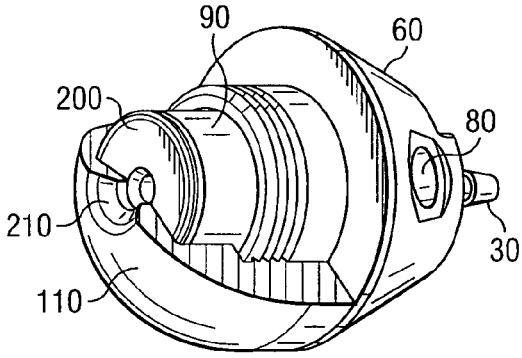
FIG. 6 shows an embodiment of the nozzle according to the present with the addition of a non-conductive element to the inside of the retaining cap.

FIG. 6 illustrates and embodiment of the present invention which includes the addition of a non-conductive element 200 to the inside of the nozzle cap 10 positioned between the ends of the retaining cap 110 and a top surface of the air cap 90. The function of the non-conductive element 200 is to increase human safety by reducing shock hazard at the nozzle tip area by providing an electrical isolation between the air cap 90 and the nozzle cap 110. The non-conductive element 200 further acts to reduce leakage currents from surfaces surrounding of the jet outlet 210 of the nozzle cap 110 that may be touched by human hands in certain applications. In accordance with various embodiments, the non-conductive element 200 is a non-conductive or substantially non-conductive disc. It is preferred that the non-conductive element 200 be a material with low electrical conductivity and low surface wettability, such as Teflon or UHMW Nylon. The addition of the non-conductive element 200 can be made without affecting any critical geometry or performance of the nozzle. The jet outlet hole 210 of the non-conductive element 200 is preferably made larger than the hole of the air cap 90 so as not to introduce any discontinuities along the wall of the air channel. Although the embodiment of FIG. 6 is illustrated as having a non-conductive element 200, it should be understood that in other embodiments the non-conductive element 200 may be omitted.

Figure 7:
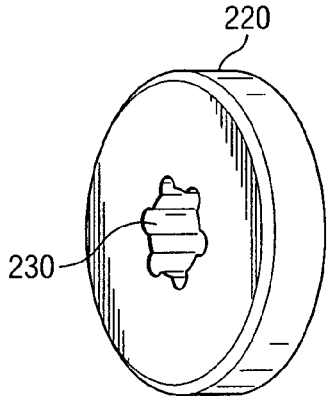
FIG. 7 is a configuration for a tool to insert or remove the liquid tip in the nozzle according to the present invention.

FIG. 7 illustrates a configuration of a tool 220 used to insert or remove the fluid tip 10 in the nozzle according to the present invention. The tool 220 has an inside bore 230 of a similar shape as the outside of the sides of the fluid tip 10. The tool 220 is positioned over the fluid tip 10 such that a portion of the fluid tip 10 extends through the inside bore 230 of the tool 220. The tool 220 is then turned by hand to tighten or loosen the fluid tip 10 from the liquid inlet connector 30 as needed. An advantage provided by an embodiment of the tool 220 is that it contacts only the sides of the fluid tip 10 in order to prevent any damage to the liquid outlet end of the fluid tip 10.

Figure 8:
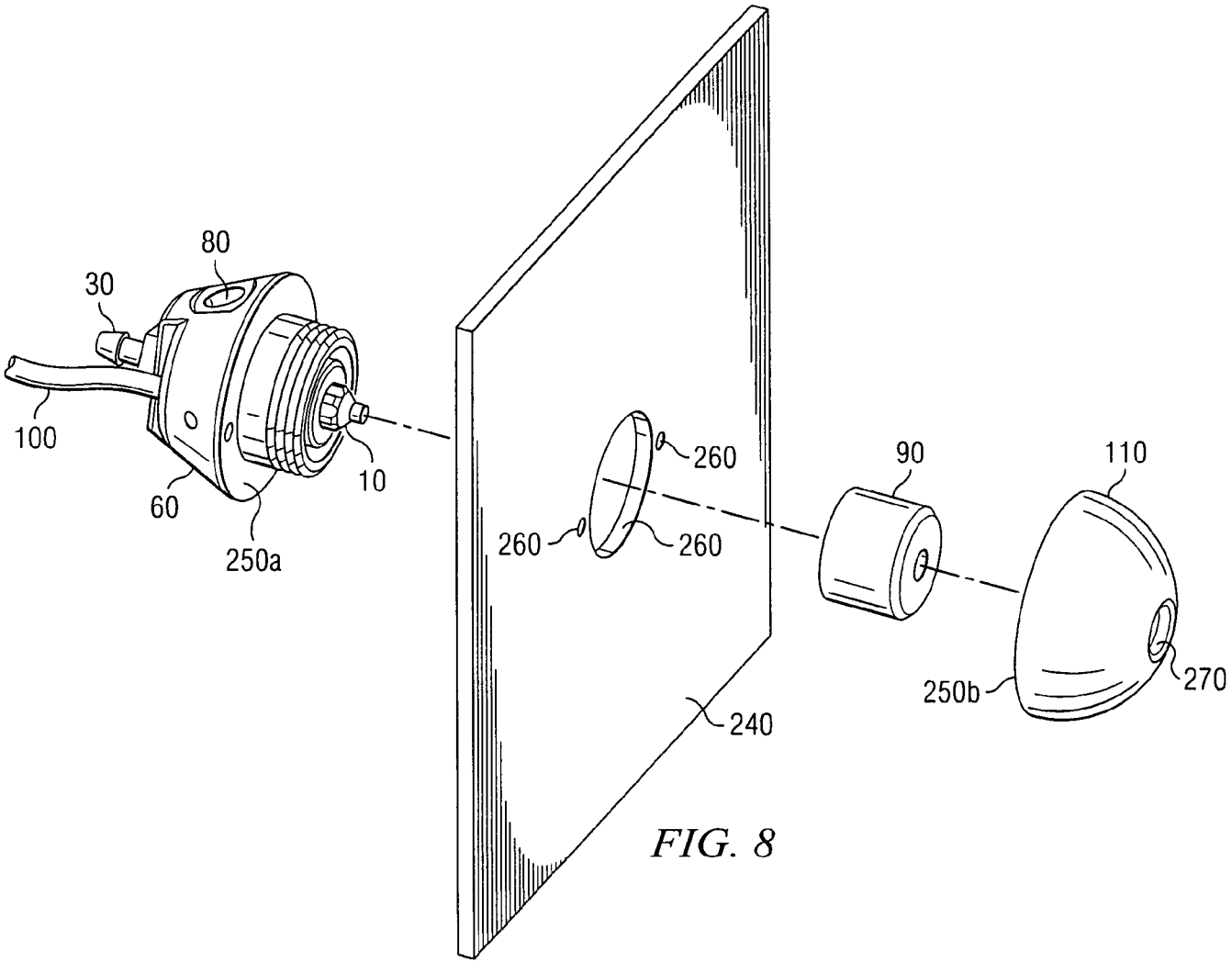
FIG. 8 is a mounting arrangement for use in an electrostatic spray charging system using a nozzle in accordance with an embodiment of the present invention.

Referring now to FIG. 8, a mounting arrangement for use in an electrostatic spray charging system using a nozzle in accordance with an embodiment of the present invention is illustrated. In the mounting arrangement of FIG. 8, components of a nozzle are mounted to an electrically insulating panel 240. The components are illustrated in FIG. 8 as suited for an air atomizing induction charging system. However, it should be understood that the system could be easily configured for contact charging by applying voltage directly to the liquid rather than an induction electrode. The main components of an induction charging system as shown include a nozzle body 60, a fluid tip 10, a nozzle cap 110, and an air cap 90 as previously described. The mounting arrangement of FIG. 8 further includes a sealing surface 250*a*, 250*b* on the nozzle body 60 and/or the nozzle cap 110, and an electrically insulating panel 240. In accordance with various embodiments of the present invention, the electrically insulating panel 240 is substantially electrically non-conductive. In accordance with various embodiments of the invention, the electrically insulating panel 240 may be made of a plastic material. In a preferred embodiment of the invention, the electrically insulating panel 240 is made of an insulating material such that electrical resistance of the insulating panel to earth ground is greater than 2 Megaohms. The nozzle body 60 is preferably made from insulating material. The nozzle body 60 further includes an air inlet 80 adapted to receive a supply of air or other gas from a source. The insulating panel 240 is further provided with a plurality of mounting holes 260. In one embodiment, the nozzle body 60 is fixedly mounted to the insulating panel 240 using mounting hardware that is coupled to the nozzle body 60 and passes through the mounting holes 260. In still another embodiment, the nozzle cap 110 is mounted to the insulating panel 240 using mounting hardware that is coupled to the nozzle cap 110 and passes through the mounting holes 260. In accordance with an embodiment, the mounting hardware can include bolts, screws, rods, attachment clips, etc. In still other embodiments, the nozzle body 60 and/or the nozzle cap 110 can be affixed to the insulating panel 240 using an adhesive.

Still referring to FIG. 8, the electrostatic spray charging system further includes a liquid inlet connector 30 adapted to be connected to a source of spray liquid and supply the spray liquid to the fluid tip 10. The electrostatic spray charging system still further includes an electrode wire 100 adapted to supply an electrostatic charge to the air cap 90. The nozzle cap 110 is provided with an spray outlet 270 allowing for a spray of electrostatically charged liquid to be sprayed from the spray nozzle assembly.

At the beginning of a spraying operation, deposition of a small amount of spray on the surface of the insulating panel 240 causes the insulating panel 240 to be charged by accumulation to the same polarity as the spray cloud. As a result, during the remaining portion of the spraying operation the spray cloud is repelled from the insulating panel 240, resulting in a reduction in the amount of spray returning to the spray nozzle and surrounding surfaces, as well as blocking nozzle surfaces from becoming coated with conductive residues. Although FIG. 8 illustrates a mounting arrangement in which a nozzle in accordance with an embodiment of the present invention is mounted to an insulating panel, it should be understood that other mounting arrangements can be used.

The sealing surface 250*a* and/or the sealing surface 250*b* functions to prevent, or at least to inhibit, current flow between the air cap 90 of the electrostatic spray nozzle assembly and a pathway to an electrical potential difference, such as a ground. The sealing surface 250*a* and/or the sealing surface 250*b* serves to prevent or inhibit the formation of charge leakage paths, the presence of which will inhibit optimal charging of the spray by the air cap 90. The prevention or inhibition of current flow between the air cap 90 and components of the electrostatic spray nozzle assembly that are positioned on the opposite side of the insulating panel 240 from the air cap 90 provided by sealing surface 250*a* and/or sealing surface 250*b* also serves to isolate a person that may come in contact with these components from electrical shock. In various embodiments of the present invention, the spray is charged to a negative charge potential with respect to ground, whereas in other embodiments the spray may be charged to a positive charge value with respect to ground.

Although various embodiments of the nozzle assemblies of the present invention have been illustrated as including fluid tip length adjustment threads on a liquid inlet connector, it should be understood that other adjustment mechanisms may be used to adjust a longitudinal distance between the liquid outlet of the fluid tip assembly and the outlet of the nozzle cap. For example, in some embodiments the adjustment mechanism can include a frictional coupling between a first end of the liquid outlet connector and a side of the nozzle body. In still other embodiments, the adjustment mechanism can include a mechanism which provides a step-wise adjustment of the longitudinal distance between the liquid outlet of the fluid tip and the outlet of the nozzle cap. In still other embodiments, the adjustment mechanism can include a threaded coupling between the fluid tip 10 and the liquid inlet connector 30.

Although a preferred embodiment of the method and apparatus of the present invention has been illustrated in the accompanying Drawings and described in the foregoing Detailed Description, it is understood that the invention is not limited to the embodiment disclosed, but is capable of numerous rearrangements, modifications, and substitutions without departing from the spirit of the invention as set forth and defined by the claims.

What is claimed:

1. An electrostatic spray charging nozzle comprising:

a nozzle cap having an outlet;

a nozzle body having a first bore, the first bore having an inner surface;

a fluid tip assembly extending at least partially through the first bore, the fluid tip assembly having an outer surface in contact with the inner surface of the first bore along first lengths of the fluid tip assembly, the outer surface not in contact with the inner surface of the first bore along second lengths of the fluid tip assembly that are adjacent the first lengths, and having a liquid inlet adapted to be connected to a source of liquid, and a liquid outlet adapted to dispense the liquid through the outlet of the nozzle cap, the second lengths defining gas channels for delivering atomizing gas to the outlet of the nozzle cap;

a conductive air cap for inductive electrostatically charging the dispensed liquid having a second bore aligned with the first bore, and positioned between the nozzle cap and the nozzle body so that a tip portion of the fluid tip assembly at the liquid outlet is received within the second bore;

a substantially non-conductive element positioned between the nozzle cap and the air cap, the substantially non-conductive element including a jet outlet hole; and an adjustment mechanism for causing longitudinal movement of the fluid tip assembly within the first bore over a range of longitudinal distances measured between the liquid outlet of the fluid tip assembly and the outlet of the nozzle cap and for setting a position of the liquid discharge outlet at any of a plurality of longitudinal distances within that range;

wherein the nozzle cap includes an aperture to removably receive the air cap.

2. The electrostatic spray charging nozzle of claim 1 wherein the nozzle body includes a first side adapted to be coupled to the nozzle cap.

3. The electrostatic spray charging nozzle of claim 2, wherein the nozzle cap is adapted for removable decoupling from the first side of the nozzle body.

4. The electrostatic spray charging nozzle of claim 1, wherein a diameter of the jet outlet hole is greater than a diameter of the air cap outlet.

5. The electrostatic spray charging nozzle of claim 1, wherein the fluid tip assembly includes a cylindrical tip end portion at the liquid outlet which extends into and adjacent an inner conductive cylindrical surface of the second bore of the conductive air cap for inductive electrostatically charging of liquid dispensed through the liquid outlet.

6. The electrostatic spray charging nozzle of claim 1, wherein the second bore of the conductive air cap defines an electrode channel which receives a tip portion at the liquid outlet of the fluid tip assembly.

7. The electrostatic spray charging nozzle of claim 1, wherein the air cap is adapted to rotate freely about the fluid tip assembly.

8. The electrostatic spray charging nozzle of claim 1, wherein the air cap is adapted for mounting within a ring cavity of the nozzle body.

9. An electrostatic spray charging nozzle, comprising:

a nozzle cap having an outlet;

a nozzle body having a first bore, the first bore having an inner surface;

a fluid tip assembly extending at least partially through the first bore, the fluid tip assembly having an outer surface in contact with the inner surface of the first bore along first lengths of the fluid tip assembly, the outer surface not in contact with the inner surface of the first bore along second lengths of the fluid tip assembly that are adjacent the first lengths, and having a liquid inlet adapted to be connected to a source of liquid, and a liquid outlet adapted to dispense the liquid through the outlet of the nozzle cap, the second lengths defining gas channels for delivering atomizing gas to the outlet of the nozzle cap;

a conductive air cap for inductive electrostatically charging the dispensed liquid having a second bore aligned with the first bore, and positioned between the nozzle cap and the nozzle body so that a tip portion of the fluid tip assembly at the liquid outlet is received within the second bore;

a substantially non-conductive element positioned between the nozzle cap and the air cap, the substantially non-conductive element including a jet outlet hole; and an adjustment mechanism for causing longitudinal movement of the fluid tip assembly within the first bore over a range of longitudinal distances measured between the liquid outlet of the fluid tip assembly and the outlet of the nozzle cap and for setting a position of the liquid discharge outlet at any of a plurality of longitudinal distances within that range;

wherein the substantially non-conductive element comprises a disc made of a fluoropolymer material.

10. An electrostatic spray charging nozzle comprising:

a nozzle cap having an outlet;

a nozzle body having a first bore;

a fluid tip assembly extending at least partially through the first bore, and having a liquid inlet adapted to be connected to a source of liquid, and a liquid outlet adapted to dispense the liquid for gas atomization through the outlet of the nozzle cap;

an air cap for inductive electrostatically charging the dispensed and gas atomized liquid, the air cap having a second bore aligned with the first bore, and the air cap positioned between the nozzle cap and the nozzle body so that the liquid outlet is received within the second bore;

wherein the air cap is adapted for removable mounting within a ring cavity of the nozzle body;

an adjustment mechanism for causing longitudinal movement of the fluid tip assembly within the first bore over a range of longitudinal distances measured between the liquid outlet of the fluid tip assembly and the outlet of the nozzle cap and for setting a position of the liquid discharge outlet at any of a plurality of longitudinal distances within that range; and an electrode contactor recessed within the ring cavity, the electrode contactor having a contact pad adapted to make electrical contact with a first surface of the air cap;

wherein the contact pad comprises a spring-loaded contact pad.

11. The electrostatic spray charging nozzle of claim 10, wherein the nozzle body includes an air inlet coupled to the first bore.

12. An electrostatic spray charging nozzle, comprising:

a nozzle cap having an outlet;

a nozzle body having a first bore;

a fluid tip assembly extending at least partially through the first bore, and having a liquid inlet adapted to be connected to a source of liquid, and a liquid outlet adapted to dispense the liquid for gas atomization through the outlet of the nozzle cap;

an air cap for inductive electrostatically charging the dispensed and gas atomized liquid, the air cap having a second bore aligned with the first bore, and the air cap positioned between the nozzle cap and the nozzle body so that the liquid outlet is received within the second bore;

wherein the air cap is adapted for removable mounting within a ring cavity of the nozzle body;

an adjustment mechanism for causing longitudinal movement of the fluid tip assembly within the first bore over a range of longitudinal distances measured between the liquid outlet of the fluid tip assembly and the outlet of the nozzle cap and for setting a position of the liquid discharge outlet at any of a plurality of longitudinal distances within that range; and an electrode contactor recessed within the ring cavity, the electrode contactor having a contact pad adapted to make electrical contact with a first surface of the air cap;

wherein the nozzle cap comprises a hemispherical nozzle cap.

13. An electrostatic spray charging nozzle, comprising:

a nozzle body having an air-channel bore;

a nozzle cap having an outlet aligned with the air-channel bore, the nozzle cap adapted for removable coupling to a first side of the nozzle body;

a liquid inlet connector having a first end mounted to a second side of the nozzle body, and a second end to be connected to a source of liquid;

a fluid tip extending through the air-channel bore and having a fluid tip base mounted to the first end of the liquid inlet connector, and a fluid tip outlet to dispense the liquid through the outlet of the nozzle cap;

a conductive air cap having a bore aligned with the air-channel bore to receive the fluid tip outlet, the conductive air cap adapted to induce a charge to the liquid;

an adjustment mechanism comprising a threaded engagement between the fluid tip assembly and the air-channel bore, wherein rotation of the fluid tip assembly through the threaded engagement causes longitudinal movement of the fluid tip assembly within the air-channel bore over a range of longitudinal distances measured between the fluid tip outlet of the fluid tip and the outlet of the nozzle cap and further sets a position of the fluid tip outlet at any of a plurality of longitudinal distances within that range; and an electrode contactor in electrical contact with the conductive air cap, the electrode contactor having a contact pad adapted to contact a first surface of the conductive air cap and apply a charge to the conductive air cap;

wherein at least a portion of the conductive air cap is recessed within a ring cavity of the nozzle body through which electrical charging connection is made.

14. An electrostatic spray charging nozzle, comprising:

a nozzle body having an air-channel bore;

a nozzle cap having an outlet aligned with the air-channel bore, the nozzle cap adapted for removable coupling to a first side of the nozzle body;

a liquid inlet connector having a first end mounted to a second side of the nozzle body, and a second end to be connected to a source of liquid;

a fluid tip extending through the air-channel bore and having a fluid tip base mounted to the first end of the liquid inlet connector, and a fluid tip outlet to dispense the liquid through the outlet of the nozzle cap;

a conductive air cap having a bore aligned with the air-channel bore to receive the fluid tip outlet, the conductive air cap adapted to induce a charge to the liquid;

an adjustment mechanism comprising a threaded engagement between the fluid tip assembly and the air-channel bore, wherein rotation of the fluid tip assembly through the threaded engagement causes longitudinal movement of the fluid tip assembly within the air-channel bore over a range of longitudinal distances measured between the fluid tip outlet of the fluid tip and the outlet of the nozzle cap and further sets a position of the fluid tip outlet at any of a plurality of longitudinal distances within that range; and an electrode contactor in electrical contact with the conductive air cap, the electrode contactor having a contact pad adapted to contact a first surface of the conductive air cap and apply a charge to the conductive air cap;

wherein the nozzle cap includes an aperture to removably receive the conductive air cap.

15. An electrostatic spray charging nozzle, comprising:

a nozzle body having an air-channel bore;

a nozzle cap having an outlet aligned with the air-channel bore, the nozzle cap adapted for removable coupling to a first side of the nozzle body;

a liquid inlet connector having a first end mounted to a second side of the nozzle body, and a second end to be connected to a source of liquid;

a fluid tip extending through the air-channel bore and having a fluid tip base mounted to the first end of the liquid inlet connector, and a fluid tip outlet to dispense the liquid through the outlet of the nozzle cap;

a conductive air cap having a bore aligned with the air-channel bore to receive the fluid tip outlet, the conductive air cap adapted to electrostatically charge the liquid by induction charging caused by a voltage potential difference generated between the conductive air cap and the fluid tip;

an adjustment mechanism comprising a threaded engagement between the fluid tip assembly and the air-channel bore and an actuator external to the nozzle body and nozzle cap to cause rotation of the fluid tip assembly within the air channel bore, wherein rotation of the fluid tip assembly through the threaded engagement causes longitudinal movement of the fluid tip assembly within the air-channel bore over a range of longitudinal distances measured between the fluid tip outlet of the fluid tip and the outlet of the nozzle cap and further sets a position of the fluid tip outlet at any of a plurality of longitudinal distances within that range; and an electrode contactor in electrical contact with the conductive air cap, the electrode contactor having a contact pad adapted to contact a first surface of the conductive air cap and apply a charge to the conductive air cap.

16. The electrostatic spray charging nozzle of claim 15, wherein the conductive air cap comprises an electrode.

17. The electrostatic spray charging nozzle of claim 15, wherein at least a portion of the electrode contactor is positioned within a channel of the nozzle body.

18. The electrostatic spray charging nozzle of claim 15, wherein the contact pad comprises a spring-loaded contact pad.

19. The electrostatic spray charging nozzle of claim 15, wherein the fluid tip is adapted to be removable from the liquid inlet connector.

20. An electrostatic spray charging nozzle, comprising:

a nozzle body having an air-channel bore;

a nozzle cap having an outlet aligned with the air-channel bore, the nozzle cap adapted for removable coupling to a first side of the nozzle body;

a liquid inlet connector having a first end mounted to a second side of the nozzle body, and a second end to be connected to a source of liquid;

a fluid tip extending through the air-channel bore and having a fluid tip base mounted to the first end of the liquid inlet connector, and a fluid tip outlet to dispense the liquid through the outlet of the nozzle cap;

a conductive air cap having a bore aligned with the air-channel bore to receive the fluid tip outlet, the conductive air cap adapted to induce a charge to the liquid;

an adjustment mechanism comprising a threaded engagement between the fluid tip assembly and the air-channel bore, wherein rotation of the fluid tip assembly through the threaded engagement causes longitudinal movement of the fluid tip assembly within the air-channel bore over a range of longitudinal distances measured between the fluid tip outlet of the fluid tip and the outlet of the nozzle cap and further sets a position of the fluid tip outlet at any of a plurality of longitudinal distances within that range;

wherein the fluid tip further includes at least one air channel along a length of the fluid tip, the at least one air channel adapted to allow air to flow along the length of the fluid tip within the air channel bore;

wherein the fluid tip is comprised of a dielectric material.

21. An electrostatic spray charging nozzle, comprising:

a nozzle body having an air-channel bore;

a nozzle cap having an outlet aligned with the air-channel bore, the nozzle cap adapted for removable coupling to a first side of the nozzle body;

a liquid inlet connector having a first end mounted to a second side of the nozzle body, and a second end to be connected to a source of liquid;

a fluid tip extending through the air-channel bore and having a fluid tip base mounted to the first end of the liquid inlet connector, and a fluid tip outlet to dispense the liquid through the outlet of the nozzle cap;

a conductive air cap having a bore aligned with the air-channel bore to receive the fluid tip outlet, the conductive air cap adapted to induce a charge to the liquid;

an adjustment mechanism comprising a threaded engagement between the fluid tip assembly and the air-channel bore, wherein rotation of the fluid tip assembly through the threaded engagement causes longitudinal movement of the fluid tip assembly within the air-channel bore over a range of longitudinal distances measured between the fluid tip outlet of the fluid tip and the outlet of the nozzle cap and further sets a position of the fluid tip outlet at any of a plurality of longitudinal distances within that range;

wherein the fluid tip further includes at least one air channel along a length of the fluid tip, the at least one air channel adapted to allow air to flow along the length of the fluid tip within the air channel bore;

wherein the nozzle cap comprises a hemispherical nozzle cap.

22. An electrostatic spray charging nozzle comprising:

a nozzle cap having an outlet;

a nozzle body having a first bore;

a fluid tip assembly extending at least partially through the first bore, and having a liquid inlet adapted to be connected to a source of liquid, and a liquid outlet adapted to dispense the liquid through the outlet of the nozzle cap;

an air cap for inductive electrostatically charging the dispensed liquid having a second bore aligned with the first bore, and positioned between the nozzle cap and the nozzle body so that the liquid outlet is received within the second bore;

wherein the air cap is adapted for mounting within a ring cavity of the nozzle body;

an adjustment mechanism for causing longitudinal movement of the fluid tip assembly within the first bore over a range of longitudinal distances measured between the liquid outlet of the fluid tip assembly and the outlet of the nozzle cap and for setting a position of the liquid discharge outlet at any of a plurality of longitudinal distances within that range; and an electrode contactor recessed within the ring cavity, the electrode contactor having a contact pad adapted to make electrical contact with a first surface of the air cap;

wherein the nozzle cap comprises a hemispherical nozzle cap.

* * * * *